US006585535B2

(12) United States Patent
Murr et al.

(10) Patent No.: US 6,585,535 B2
(45) Date of Patent: Jul. 1, 2003

(54) ELECTRICAL CONTACT FOR LGA AND BGA ELECTRICAL PACKAGES

(75) Inventors: Keith McQuilkin Murr, Etters, PA (US); Ben Howard Mosser, III, Middletown, MA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/757,193

(22) Filed: Jan. 9, 2001

(65) Prior Publication Data

US 2003/0008570 A1 Jan. 9, 2003

(51) Int. Cl.[7] ..... H01R 13/62

(52) U.S. Cl. ..... 439/331; 437/946; 437/862; 437/607; 235/441

(58) Field of Search ..... 439/73, 331, 862, 439/928.1, 946, 630, 633, 607, 44; 235/441

(56) References Cited

U.S. PATENT DOCUMENTS 4,346,952 A * 8/1982 Bright et al. ..... 439/76.1
5,231,274 A * 7/1993 Reynier et al. ..... 235/441
5,653,598 A 8/1997 Grabbe
5,913,700 A 6/1999 Tobey et al.
5,984,693 A 11/1999 McHugh et al.
6,015,311 A * 1/2000 Benjamin et al. ..... 439/267
6,019,611 A 2/2000 McHugh et al.
6,068,516 A * 5/2000 Chang ..... 439/633
6,077,089 A 6/2000 Bishop et al.
6,083,022 A 7/2000 Walkup
6,095,868 A * 8/2000 Hyland et al. ..... 439/630
6,244,875 B1 * 6/2001 McHugh et al. ..... 439/73

* cited by examiner

*Primary Examiner*—Tho D. Ta
*Assistant Examiner*—James R. Harvey

(57) ABSTRACT

An electrical contact and electrical connector are provided for use in connecting a circuit board with an electrical module. The connector includes a socket and contact assembly that are solderably secured to the circuit board. A retention clip is removable snapped on the socket to retain an electrical module within the socket and in electrical communication contact with the contacts, thereby interconnecting the electrical module with the circuit board. The retention clip is removable to permit replacement of the module. The electrical contact includes a solder member mounted to a shorting member to permit the contact to be solderably connected to the printed circuit board, while permitting a non-soldered connection between the module and the socket. The contact includes an upper interface that is biased in a manner to form a shorted electrical path between the module and circuit board when the module is biased downward onto the contact.

28 Claims, 5 Drawing Sheets

ELECTRICAL CONTACT FOR LGA AND BGA ELECTRICAL PACKAGES

CROSS REFERENCE TO RELATED APPLICATIONS (IF APPLICABLE)

STATEMENT REGARDING FEDERALLY SPONSORED RESEARCH & DEVELOPMENT (IF APPLICABLE)

BACKGROUND OF THE INVENTION

The preferred embodiments of the present invention generally relate to electrical contacts and connectors for use with electronic packages or modules having leads arranged in a ball grid array (BGA) or a land grid array (LGA).

Electronic packages or modules with leads arranged in BGA or LGA configurations have been proposed in the past having relatively low vertical profiles to conserve space within an electronic assembly. Conventional packages and modules have been surface mounted directly to a circuit board in a soldering process wherein the leads are solder bonded to a corresponding array of circuit pads on the board. However, directly soldering electronic packages and modules to a circuit board has the drawback that the package is not easily removable for replacement or upgrade.

Connectors have been proposed in the past for removably mounting an electronic package or module on a circuit board. At least one conventional connector configuration comprises a flat dielectric housing which resides between the electronic package and the circuit board. The dielectric housing has an array of cavities in which are disposed electrical contacts arranged in correspondence with the array of leads of the electronic package. The contacts in the connection have ends projecting beyond the surfaces of the connector housing. When the electronic package or module is mounted on the connector, each contact has one end engaging the electronic package, while the other end engages a circuit pad on the circuit board. Compression forces are applied to the electronic package to assure firm engagement with the ends of the contacts. By way of example, the compression forces may be applied through pressure plates fastened together to sandwich the package, connector and circuit board therebetween.

Modem electronic components are designed with strict emphasis on their horizontal and vertical profiles. In certain applications, such as in laptop computers, cell phones, personal digital assistants, palm pilots and the like, a significant effort is made to minimize the vertical profile. Thus, it is desirable to maximize the working range within the height of a connector.

Conventional connectors for electronic packages are typically mounted to a printed circuit board via through holes. The sockets are located above plated round holes extending through the board, through which solder is inserted to mount the socket to the printed circuit board. In the more recent past, it has become desirable to surface mount connectors to printed circuit boards. Surface mounted sockets are not secured via through holes to the printed circuit board, but instead may be secured via bolts or other latching mechanisms to the board. As circuit designs become smaller, the vertical height of the connector becomes a greater concern. Conventional connectors have presented overall heights that are taller than desired for certain applications. The overall height of existing connectors is partially determined by the configuration of the contacts used therein.

In addition, existing connectors present a longitudinal and lateral envelope slightly larger than the size of the electronic package or module included within the connector. As circuit designs become smaller, it becomes more desirable that the longitudinal and lateral envelope of the connector not unduly exceed similar dimensions of the electronic module or package.

Conventional connectors include a socket and a cover mounted thereon to enclose the electronic module or package. Conventional covers are secured to the socket by a mechanism requiring a screwdriver to unscrew or pop the cover loose. Conventional latching mechanisms securing the cover to the socket add to the envelope of the connector, either in the vertical profile and/or in the longitudinal and/or lateral directions. It is desirable to minimize the increase in the connector envelope due to the cover latch.

Further, modem electrical equipment operates at very high switching frequencies, thereby giving rise to significant self inductance effects which may interfere with proper equipment operation. Self inductance may be reduced by reducing the length of a circuit path through a contact. However, it is also desirable to provide adequate length to a contact to permit deflection of the contact without deformation thereof and without degrading the biasing characteristics of the contact. In order to address the above-noted problems, contacts have been proposed with spring arms for deflection compliance and with shorting arms which interconnect free ends of the spring arms to provide a shortened current path through the contact. An example of one such contact is in U.S. Pat. No. 5,653,598. The contact configuration described in the '598 patent constitutes a compression mount, whereby the contacts are not soldered to the circuit board or to the electrical package. Thus, the contact configuration of the '598 patent forms a separable interface through the use of non-soldered interconnections. The contacts of the '598 patent utilize gold plating on the circuit board and on the electrical package to achieve adequate electrical connection characteristics therebetween.

However, in certain circumstances, it may be desirable to avoid or limit the use of gold plating on the circuit board and on the electronic package since gold may be overly expensive for certain applications. Therefore, an improved contact configuration is desirable which reduces the usage of gold to achieve satisfactory electrical connection characteristics, while enabling electronic packages to be easily removed without unsoldering such packages.

A need remains for all improved contact configuration that satisfies the above-discussed needs and that addresses other considerations that will be apparent from the following description and drawings.

BRIEF SUMMARY OF THE INVENTION

An electrical connector is provided in connection with at least one preferred embodiment of the present invention for electrically engaging an electronic module with a circuit board. The connector includes a socket having a base adapted to receive the module. The socket includes a plurality of board locking members mounting the socket to the circuit board. The socket also includes a plurality of contact cavities. Contacts are securely fixed in the contact cavities with each contact having a first engaging surface for electronically engaging the module and having a second engaging surface for electronically engaging the circuit board. A retention clip is removably secured to the socket and is configured to sandwich the module between the clip and socket with a predetermined amount of force. The socket may include end and side walls and a configuration of support ribs interconnecting the end and side walls. The socket and retention clip have a locking assembly interconnecting the retention clip and socket. The retention clip includes at least one biasing member abutting against and biasing the electronic module downward against the socket when the retention clip is secured to the socket. The biasing member provides sufficient force to bias the contacts until the first and second engaging surfaces are interconnected along a shortened circuit path.

According to at least one preferred embodiment, the biasing member includes a plurality of fingers mounted to the retention clip. The fingers project downward toward the socket with a predetermined amount of force. The fingers press against the module when the retention clip is secured to the socket. In an alternative embodiment, the biasing member includes fingers integrally formed with a top surface of the retention clip. The fingers bend downward into a cavity defined between the retention clip and socket, wherein the cavity receives the module. In accordance with an alternative embodiment, the biasing member includes fingers integrally formed with the side and end walls. The fingers are bent inward to project toward and forcibly engage the module. The biasing members maintain the engaging surfaces on the contacts in electrical communication with the module.

In accordance with at least one alternative embodiment, the clip/socket locking assembly includes locking protrusions mounted on opposite ends of the retention clips and opening in opposite ends of the retention clip. The locking protrusions are snappingly secured into the openings to secure the retention clip to the socket. The locking assembly includes opposed clips mounted on the socket. The clips snappingly engage opposed walls of the retention clip. The retention clip includes end walls integrally formed with the support ribs. The support ribs bias the end walls inward toward one another to snapably engage the socket. The end walls are bent outward to release the socket.

In accordance with one embodiment, the socket includes standoffs mounted on a bottom surface of the socket. The standoffs have predetermined lengths that maintain a minimum distance between the socket and the circuit board to prevent the contacts from being crushed when the socket is mounted on the circuit board.

In accordance with one embodiment, the board locking members include a plurality of barb locks projecting downward from the socket. The board locks include retention barbs on a periphery thereof forming an interference fit with corresponding openings in the circuit board. The socket has board lock housings extending outward from opposite sides of the socket. The board lock housings frictionally retain the board locking members. The locking assembly may include a slot between the socket and retention clip to receive a tool to release the retention clip from the socket. The socket may include end and side walls to laterally and longitudinally locate the module in a desired position relative to the contacts. The socket may also include keys shaped to mate with corresponding cutouts in the module. The keys insure proper orientation and positioning of the module.

In accordance with yet another alternative embodiment, an electrical contact is provided for use in a connection between a circuit board, a socket and a module retained in the socket. The contact includes a base shorting member having side walls and front and rear ends. The shorting member is adapted to be securely mounted in the socket. The contact further includes an upper interface having a spring arm connected to, and biased upward from, the base shorting member. The upper interface has an upper end adapted to electronically engage the module. A solder member is mounted to, and extends downward from, the base shorting member. The solder member is adapted to be soldered to the circuit board.

In accordance with at least one embodiment, the base shorting member, upper interface and solder member are aligned in a common plane. The base shorting member, upper interface and solder member may be formed integrally with one another and may be aligned to form a general planar contact body.

In accordance with at least one alternative embodiment, the front end of the base shorting member has a first lobe and the upper end of the upper interface has a second lobe. The first and second lobes may be aligned to engage one another to form a shorted electrical path therebetween when the upper interface is deflected toward the base shorting member. The front end of the base shorting member and the upper end of the upper interface may have chamfered edges aligned with one another to form a shorting electrical connection therebetween when the upper interface and base shorting member are bent toward one another. The upper interface may be formed to angularly diverge from the base shorting member as they extend away from one another when in an unbiased state.

In accordance with one embodiment, the solder member may include a J-shaped lead having outer and inner ended portions interconnected through an intermediate portion. The inner end is electrically connected to the shorting base member at an intermediate point along a length of the shorting base member. The outer end of the solder member may be adapted to be received within a volume of solder connecting the solder member to the circuit board. The solder wicks upward, during a solder reflow operation, along the outer end portion of the solder member. The solder member, and in particular the outer end portion, may have a length determined, in part, by the volume of solder used to prevent excess wicking along the solder member. The solder member, and in particular the intermediate portion, may have a length that is determined, in part, based on a difference between coefficients of thermal expansion of the circuit board and the socket. The intermediate portion and more generally the solder member as a whole preferably has sufficient length to permit relative movement between the socket and circuit board due to different coefficients of thermal expansion of the socket and circuit board. The intermediate portion flexes as the socket and circuit board expand and contract without cracking the solder.

BRIEF DESCRIPTION OF THE DRAWINGS

The foregoing summary, as well as the following detailed description of the preferred embodiments of the invention, will be better understood when read in conjunction with the appended drawings. For the purpose of illustrating the preferred embodiments of the present invention, there is shown in the drawings embodiments which are presently preferred. It should be understood, however, that the present invention is not limited to the precise arrangements and instrumentality shown in the attached drawings.

DETAILED DESCRIPTION OF THE INVENTION

Figure 1:
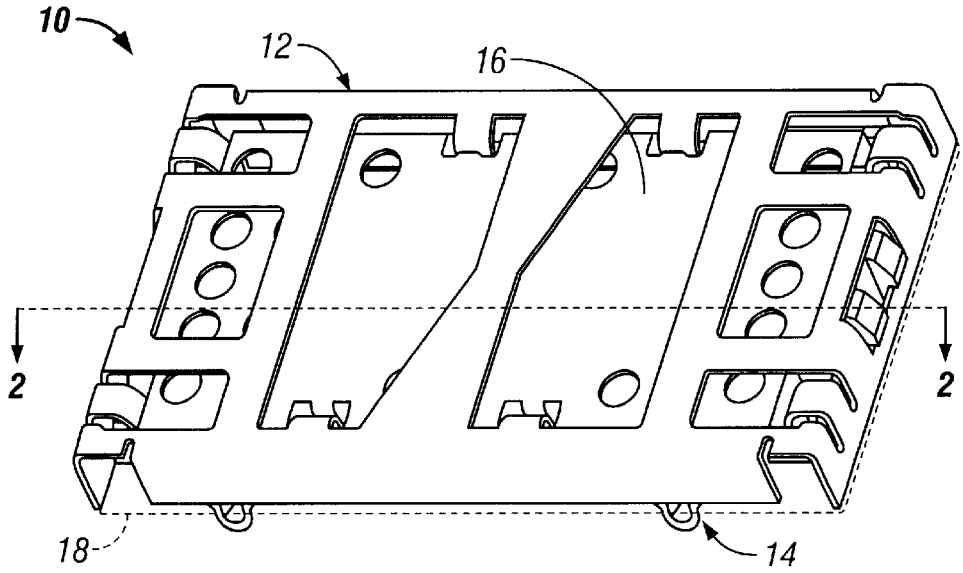
FIG. 1 illustrates a perspective view of an electrical connector corresponding to a preferred embodiment of the present invention.

FIG. 1 illustrates an electrical connector 10 including a retention clip 12 that is snappingly secured to a socket 14 to compressibly enclose an electrical package or module 16 therebetween. The socket 14 is securely mounted to a circuit board 18. The electrical connector 10 electronically connects the module 16 to the circuit board 18 in a manner that permits the module 16 to be replaced periodically without unsoldering any soldered connections, while limiting an amount of gold plating used in non-soldered connections.

Figure 2:
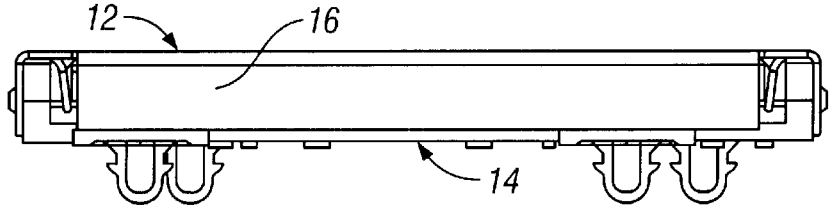
FIG. 2 illustrates a cross-sectional view taken along line 2—2 in FIG. 1.

FIG. 2 illustrates a cross-sectional view taken along line 2—2 in FIG. 1 of the electrical connector 10. As shown in FIG. 2, the retention clip 12 and socket 14 define a cavity therebetween to receive the module 16 in a secure manner at a known position and orientation relative to the socket 14 and therefore relative to the circuit board 18.

Figure 3:
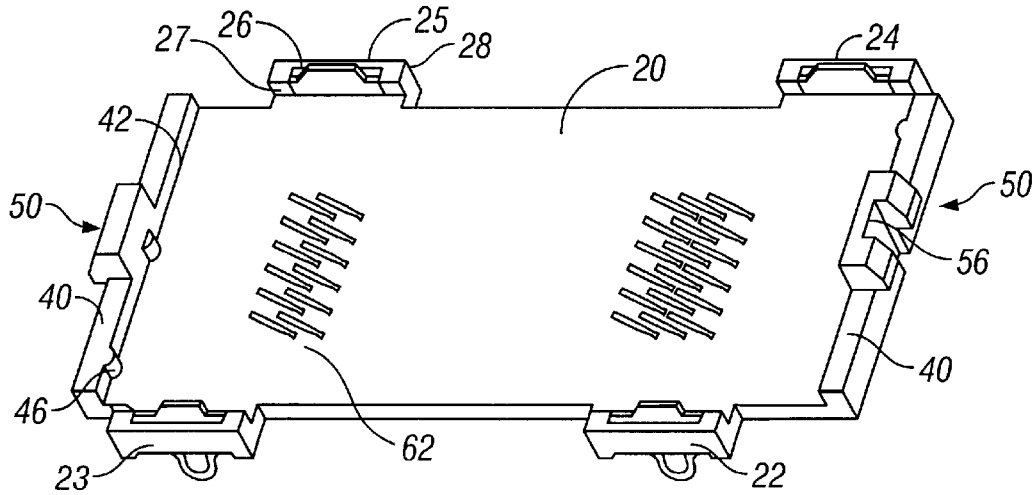
FIG. 3 illustrates a perspective view of a socket formed in accordance with a preferred embodiment of the present invention.

FIG. 3 illustrates a perspective view of the socket 14. The socket 14 includes a base 20 shaped in a substantially rectangular configuration. Optimally, the base 20 may be shaped in any manner dependent upon the shape of the module 16 to be retained thereon. The socket 14 includes side flanges 22–25 formed on opposite sides of the base 20 and projecting upward therefrom. In the embodiment of FIG. 3, the side flanges 22–25 are located opposed from one another and proximate opposite ends of the base 20. Optionally, the number of side flanges 22–25 and the position of the side flanges 22–25 may be varied. The side flanges 22–25 in the example of FIG. 3 are formed integral with the base 20.

Figure 4:
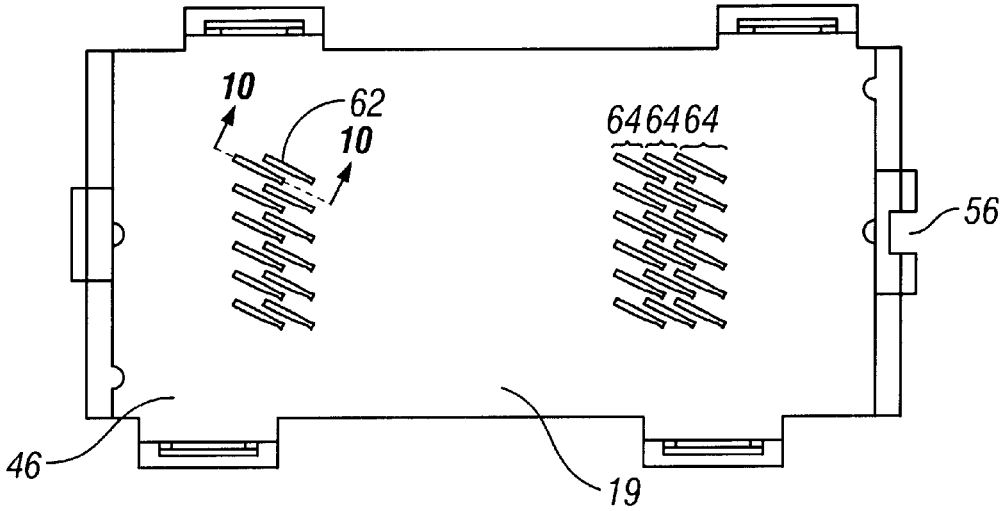
FIG. 4 illustrates a top plan view of a socket formed in accordance with the preferred embodiment of the present invention.
Figure 5:
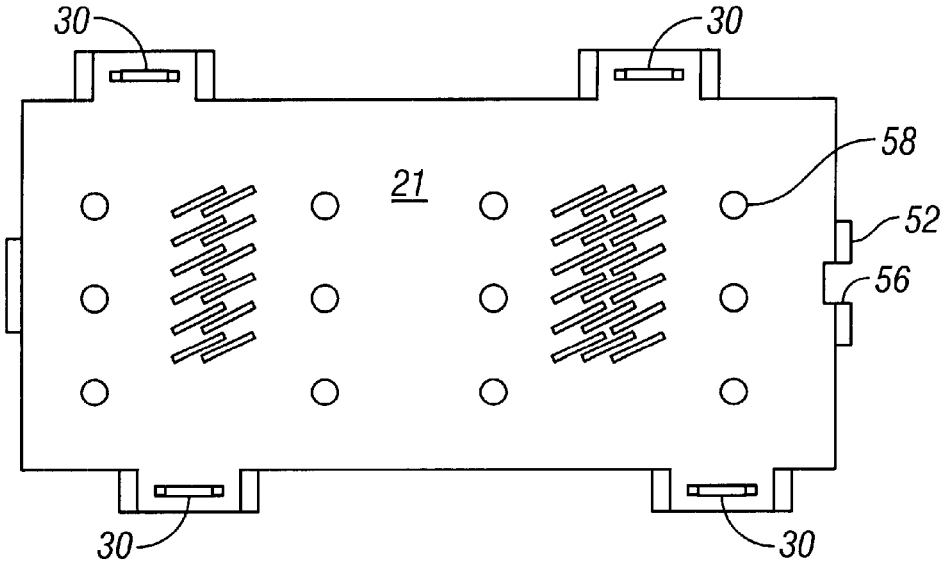
FIG. 5 illustrates a bottom plan view of a socket formed in accordance with a preferred embodiment of the present invention.
Figure 7:
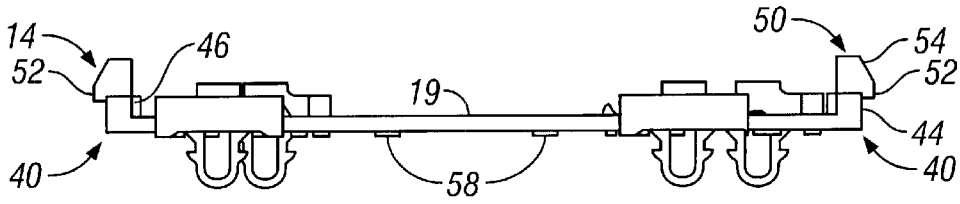
FIG. 7 illustrates a side view of a socket formed in accordance with a preferred embodiment of the present invention.

FIGS. 4, 5, and 7 illustrate the flanges 22–25 in more detail. Each side flange 22–25 includes a cutout center section 26 between side surfaces 27 and 28. The side surfaces 27 and 28 abut against the sides of the module 16 to locate the module 16 laterally at a desired position. A base portion of each flange 22–25 includes a notch 30. The cutouts 26 and notches 30 receive board locks 32.

Figure 6:
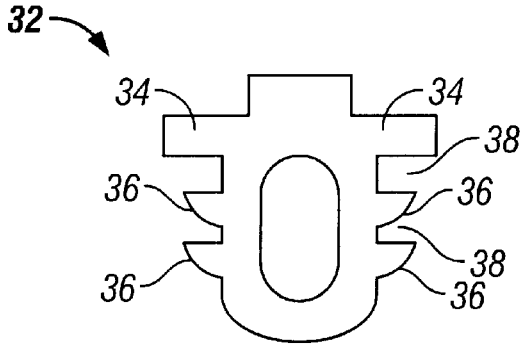
FIG. 6 illustrates a side view of a board lock formed in accordance with a preferred embodiment of the present invention.

FIG. 6 illustrates the board locks 32 in more detail. Each board lock 32 is formed in a substantially T-shaped configuration with upper arms 34 shaped to be slidably and securely received within the cutouts 26 and the flanges 22–25. The board locks 32 include a series of upper and lower retention barbs 36 on either side thereof. Notched openings 38 are located between the retention barbs 36 and upper arms 34. When assembled, the board locks 32 are inserted downward into the cutouts 26 until the upper and lower retention barbs 36 pass through the notches 30 and the flanges 22–25. The notches 30 are dimensioned such that base portions of the flanges 22–25 are snuggly received within the upper set of notches 38 immediately below the upper arms 34 of the board locks 32, thereby retaining the board locks 32 within the socket 14.

The printed circuit board 18 upon which the socket 14 is to be mounted similarly is provided with a set of notches (not shown) to align with the board locks 32. The notches in the circuit board 18 are also dimensioned to snuggly fit within the lower set of notches 38 defined between the pairs of retention barbs 36, in order to retain the socket 14 upon the circuit board 18. The board locks 32 and notches in the circuit board 18 are dimensioned with relatively close tolerances in order to align contacts (described in more detail below) in the socket 14 with electrical circuit paths provided in the circuit board 18.

Turning to FIG. 7, a side view is illustrated of the socket 14 separate and apart from the retention clip 12 and module 16. The socket 14 includes end walls 40 extending upward substantially along the entire width of the ends of the base 20. The end walls 40 have inner faces 42 and outer edges 44. At least one of the inner faces 42 includes keying projections 46 thereon extending inward into the chamber defined to receive the module 16. The keying protrusions 46 may be formed integral with the end walls 40 which in turn may be formed integral with the base 20. The keying protrusions 46 are configured to align with and fit into keying slots 48 (FIG. 8) formed in opposite ends of the module 16. The end walls 40 further include latches 50 centered thereon and extending upward therefrom. The latches 50 snappingly engage, and retain, the retention clip 12. The latches 50 include protrusions 52 extending outward from the base 20 in opposite directions beyond the outer edges 44 of the end walls 40. The protrusions 52 are formed with beveled outer, upper edges 54 that permit easy assembly of the, retention clip 12. In the embodiment of FIG. 3, the latches 50 include notches 56 (FIGS. 4 and 5) therein extending along an outer side of the latches 50 and in a vertical direction. The notches 56 facilitate removal of the retention clip when it is desirable to replace or gain access to the module 16.

As shown in FIGS. 5 and 7, the bottom surface 21 of the base 20 includes a plurality of standoffs 58 distributed thereover. The standoffs 58 are formed with a predetermined height sufficient to maintain a desired minimum distance between the bottom surface 21 of the base 20 and the upper surface of the circuit board 18. The standoffs 58 insure that the contacts 60 mounted in the base 20 are not crushed when the socket 14 is mounted on the circuit board 18.

Figure 10:
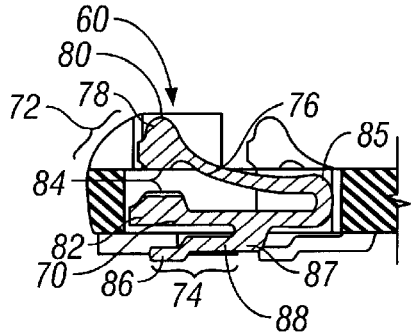
FIG. 10 illustrates a cross-sectional view of a contact taken along lines 10—10 in FIG. 4 formed in accordance with a preferred embodiment of the present invention.

In the embodiment of FIG. 7, the overall height of the base 20 relative to the top surface of the printed circuit board is preferably minimized, such as to one millimeter and the like from the top surface of the printed circuit board to the top surface 19 of the base 20. The distance from the top of the circuit board to the top surface 19 is minimized in connection with at least one preferred embodiment by utilizing a contact 60 having a very low vertical profile. The vertical profile of the contact 60 may be minimized by constructing the features of the contact 60 to extend in the horizontal direction (as illustrated in FIG. 10), while minimizing the feature set of the contact 60 extending in the vertical direction.

As shown in FIGS. 4 and 5, the base 20 includes a plurality of channels 62 formed therein and extending therethrough. The channels 62 are formed in a rectangular shape and aligned (in one embodiment) at an acute angle with respect to the longitudinal axis of the base 20. The channels 62 are grouped in rows 64, with each row 64 aligned in an offset and overlapping manner with respect to the adjacent rows 64 of channels 62. Each channel 62 receives a contact 60 that is forcibly inserted into the channel 62 and retained therein in a frictionally fit.

Optionally, the solder member 74 may vary in length and shape. The outer end portion 86 of the solder member 74 may have a length adapted to be soldered to the circuit board 18. The solder is melted during a "reflow" operation permitting the outer end portion 86 to be embedded within the solder. During the reflow operation, the solder may wick upward along the outer end portion 86 of the solder member 74 a distance dependent upon the volume of solder used. The length of the outer end portion 86 is determined to be sufficient to prevent excess wicking of the solder. Thus, the length of the outer end portion 86 and the solder member 74 is dependent in part upon the amount of solder used to connect each contact 60 to the circuit board 18.

Figure 9:
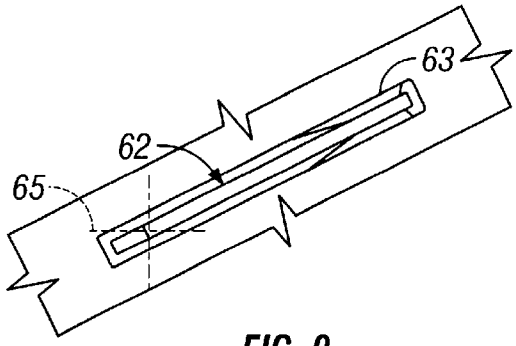
FIG. 9 illustrates a top view of a channel cut in a socket in accordance with a preferred embodiment of the present invention.

As shown in FIG. 9, each channel 62 may be formed with a tapered width to be narrower proximate one end 63 and wider proximate the other end 65. The contacts 60 have an even thickness, thereby easily sliding into the wide end 65 and frictionally engaging the narrow end 63. Optionally, the contract 60 may gauge into the interior sides of the channel 62 proximate the narrow end 63.

FIG. 10 illustrates a sectional view taken along line 10—10 in FIG. 4 of a contact 60 mounted in a channel 62. The contact 60 includes an intermediate shorting member 70 formed integrally with an upper interface 72 and a solder member 74. In the embodiment of FIG. 10, the upper interface 72 includes a spring arm 76 having a lobe 78 formed on the outer end thereof. The upper edge of the lobe 78 forms a module engaging face 80. The intermediate shorting member 70 includes a lobe 82 on the outer end thereof. The lobes 78 and 82 include shorting faces aligned with one another and that may be formed at angled chamfered edges, such as 45°. The spring arm 76 and shorting member 70 are interconnected via a flexible arcuate resilient bridge 86. The solder member 74 joins the shorting member 70 at an intermediate point along the length of the shorting member 70. The solder member 74 is shaped as a J-lead with an outer end portion 86 shaped to be soldered to an electrical path on the circuit board 18, an inner end portion 87 joining the shorting member 70 and an intermediate portion 88.

Optionally, the solder member 74 may vary in length and shape. The outer end portion 86 of the solder member 74 may have a length adapted to be soldered to the circuit board 18. The solder is melted during a "reflow" operation permitting the outer end portion 86 to be embedded within the solder. During the reflow operation, the solder may wick upward along the outer end portion 86 of the solder member 74 a distance dependent upon the volume of solder used. The length of the outer end portion 86 is determined to be sufficient to prevent excess wicking of the solder. Thus, the length of the outer end portion 86 and the solder member 74 is dependent in part upon the amount of solder used to connect each contact 60 to the circuit board 18.

The shorting member 70 also includes an intermediate portion 88 having a length sufficient to permit movement between the socket 14 and circuit board 18. It may be desirable to permit relative movement between the socket 14 and the circuit board 18 as these components typically exhibit different coefficients of thermal expansion. As temperatures vary, the socket 14 expands and contracts by an amount dependent upon the size of the socket and the materials from which the socket 14 are formed. Similarly, as temperatures fluctuate, the circuit board 18 expands and contracts. However, as the socket 14 and circuit board 18 are of different size and formed from different materials, they expand and contract by different amounts. The amount of expansion and contraction may be characterized by their coefficients of thermal expansion. The solder member 74 is provided with sufficient length to be bent during relative movement between the socket 14 and circuit board 18 without cracking the solder connection between the circuit board 18 and the outer end 86 of the contact 60. The intermediate portion 88 of the solder member 74 may flex in order to prevent cracking of the solder connection. The coefficient of thermal expansion (CTE) becomes more important as components become bigger. The CTE is of less importance in conventional socket configurations that simply maintain an abutting relation between the contacts and electrical paths on the circuit board without soldering such members to one another.

Optionally, the solder member 74 may be mounted to the contact 60 at a different position. For instance, the solder member 74 may be secured to the contact 60 at a point closer to or further from the arcuate portion 85 of the contact 60.

Figure 11:
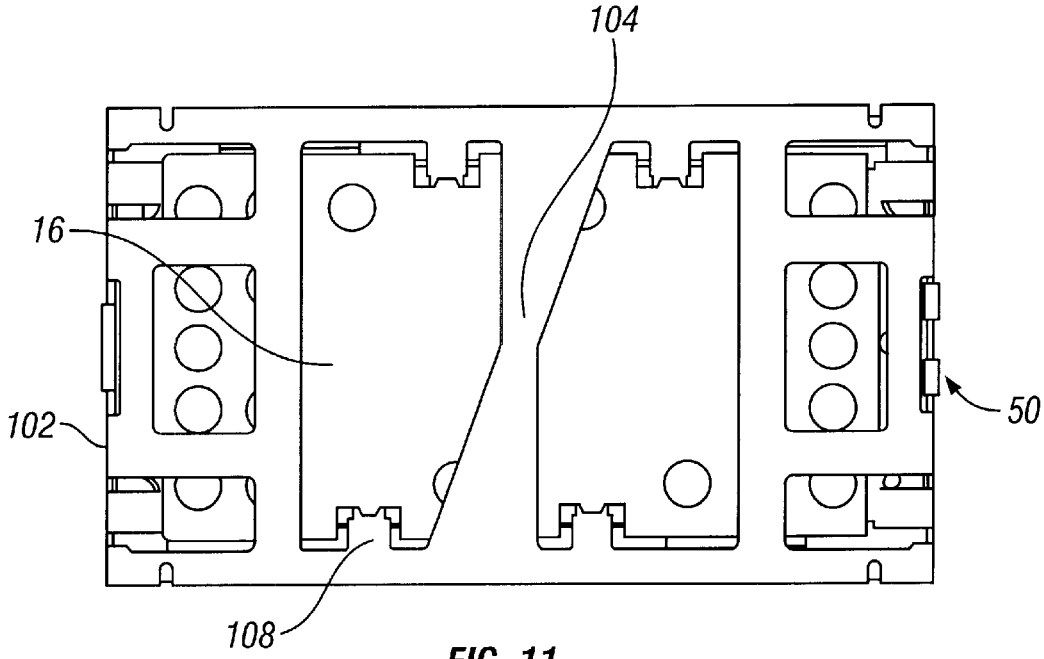
FIG. 11 illustrates a top plan view of an electrical connector and module formed in accordance with a preferred embodiment of the present invention.
Figure 12:
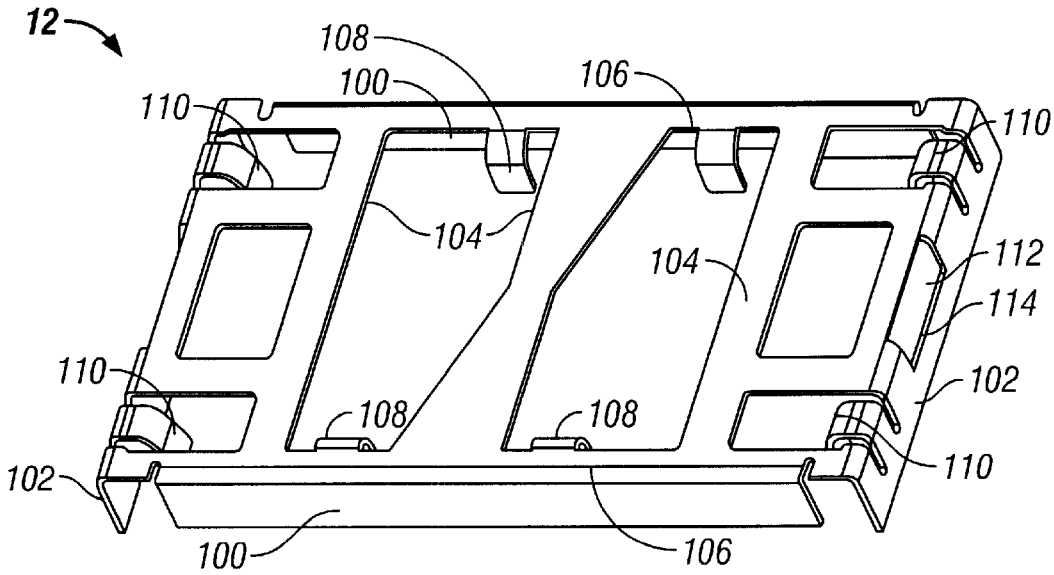
FIG. 12 illustrates a perspective view of a retention clip formed in accordance with a preferred embodiment of the present invention.
Figure 13:
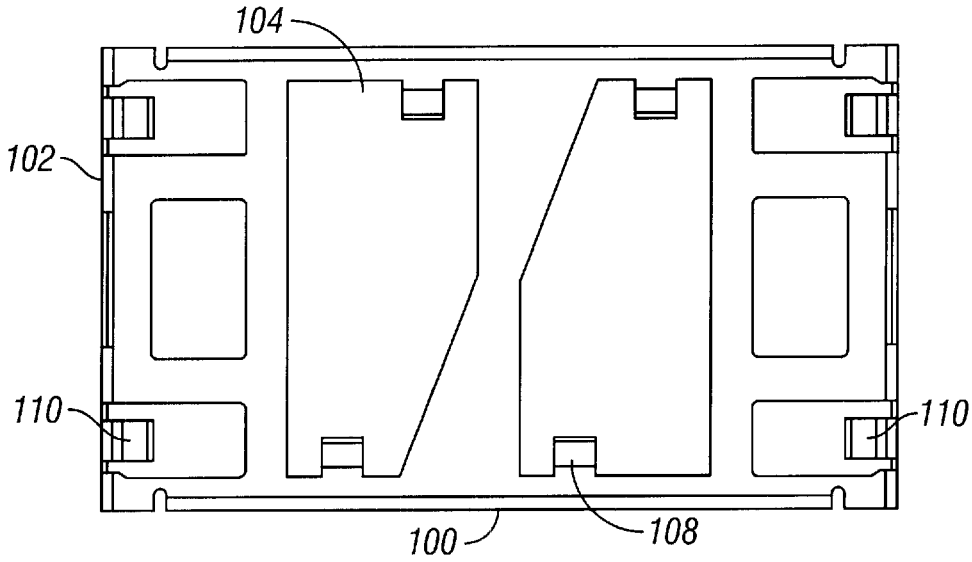
FIG. 13 illustrates top plan view of a retention clip formed in accordance with a preferred embodiment of the present invention.
Figure 14:
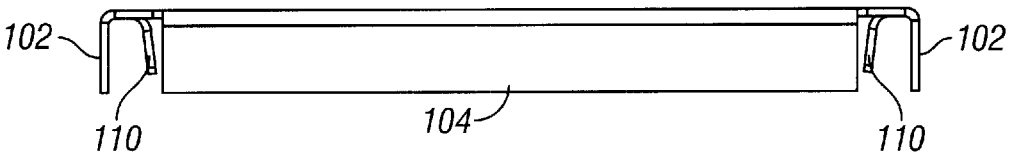
FIG. 14 illustrates a side view of a retention clip formed in accordance with a preferred embodiment of the present invention.

Turning to FIGS. 11 and 12, the retention clip 12 is now discussed in more detail. The retention clip 12 includes side walls 100 and end walls 102. The side walls 100 and end walls 102 are interconnected through a supporting rib configuration 104. The rib configuration 104 includes opposed outer longitudinal ribs 106 extending along a length of the retention clip 12. The longitudinal ribs 106 include a plurality of retention beams 108 formed thereon and extending inward and downward from the rib configuration 104. The retention beams 108 are directed to abut against the module 16 to press the module 16 downward onto the contacts 60 mounted in the base 20 of the socket 14. While the retention beams 108 are flexible, the retention beams 108 exhibit sufficient resiliency to apply a desired amount of force against the module 16. The end walls 102 also include a plurality of retention fingers 110 formed therewith and bent inward and downward from the rib configuration 104. The fingers 110 function in the same manner as retention beams 108 to bias the module 16 against the socket 14. Optionally, the number of fingers may be modified. Optionally, the size of the fingers and locations thereof may similarly be varied, including mounting the retention beams 108 and 110 upon various portions of the rib configuration 104, end walls 102 and side walls 100.

Figure 8:
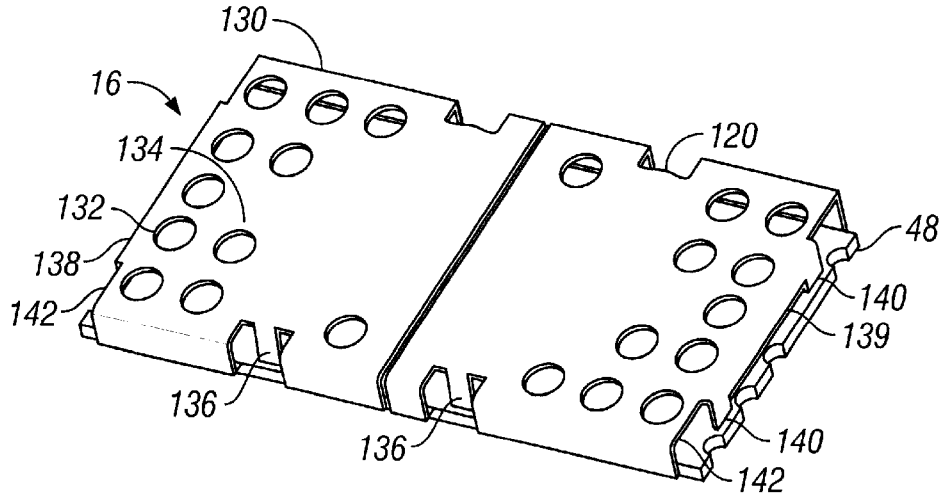
FIG. 8 illustrates an exemplary module used with an electrical connector formed in accordance with the preferred embodiment of the present invention.

FIG. 8 illustrates an exemplary module 17 comprised of an electronic component within a protective shell 130. The shell 130 includes a plurality of openings 132 on an upper surface 134. The shell 130 includes a plurality of exposure notches 120 cut into the shell 130 and arranged along either side of the shell 130. Within the notches 120, fingers 136 are formed integral with the shell 130 and bent to project downward. The fingers 136 are soldered to the electronic component enclosed in the shell 130.

Opposite ends 138, 139 of the shell 130 include outer flanges 140 bent downward to contact the ends of the electronic component. The flanges 140 may be formed integral with the shell 130, and may be soldered to the electronic component. The flanges 140 and fingers 136 may be stamped from the shell 130 and bent accordingly. Once the flanges 140 and fingers 136 are bent, exposure notches 120 and 142 are formed. The retention beams 108 and 110 are shaped to fit the exposure notches 120 and 142.

The overall longitudinal and lateral dimensions of the retention clip 12 are minimized by aligning the retention beams 108 and 110 with the exposure notches 120 and 142.

The end walls 102 include openings 112 centered therein and located opposed to one another. The openings 112 are configured to align with the latches 50. Each end wall 102 includes a retention edge 114 in the opening 112 which is secured under the protrusions 52 on the latches 50 once the retention clip 12 is snapped over the socket 14 and module 16.

Figure 15:
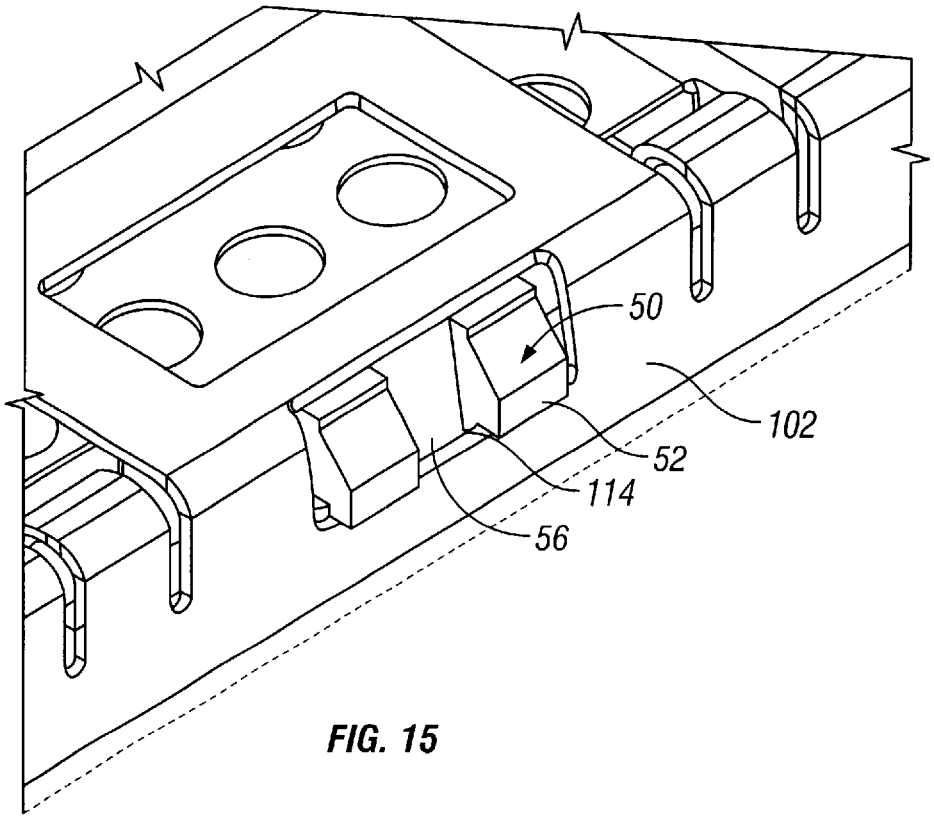
FIG. 15 illustrates a perspective view of a locking mechanism used in connection with a preferred embodiment if the present invention.

As illustrated in FIG. 15, the notch 56 in the latch 50 forms an opening behind the retention edge 114, thereby permitting a tool to be inserted behind the end wall 102 in order to pry the end wall 102 outward and over the protrusions 52 on the latch 50. To remove the retention clip 12, a small tool is inserted into the notch 56 behind the end wall 102 and a slight pressure is applied downward on the retention clip 12, while the tool is rotated inward towards the socket 14. This action deflects the end wall 102 out and over the latch 50. Once the module 16 is replaced, the retention clip 12 may be replaced by pressing the end walls 102 downward against the beveled edges 54 until the end walls 102 flex outward and over the latches 50.

FIG. 8 illustrates an exemplary module 16 including notched side sections 120 that receive the retention beams 108.

The end walls 102 and side walls 100 are thin and conform closely against the exterior of the socket 14. The retention clip 12 provides a longitudinal and lateral envelope that is only slightly longer than the dimensions of the module 16.

Optionally, the retention clip 12 may be modified to omit the rib support structure 104, and merely include the retention beams 108 and 110 formed directly on the side walls 100 and end walls 102, respectively.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An electrical connector, comprising:

a socket having a base and having socket side walls and socket end walls on opposite sides and ends, respectively, of said base to define a chamber adapted to receive a module, said socket including a plurality of board locking members configured to surface mount said socket to a circuit board, said base including a plurality of contact cavities; contacts securely fixed in said contact cavities;

a retention clip having clip end walls snapably secureable to said socket end walls, said retention clip including at least one biasing member adapted to abut against and bias a module against said socket when said retention clip is interlocked to said socket.

2. The electrical connector of claim 1 wherein said clip end walls of said retention clip are snapped over said socket end walls of said socket when said retention clip is loaded onto said socket.

3. The electrical connector of claim 1 wherein said retention clip is mounted in a downward direction onto said socket and wherein said retention clip is adapted to apply a bias force in said downward direction on a module held between said retention clip and socket.

4. The electrical connector of claim 1 wherein said retention clip is snapped downward onto a top of said socket.

5. The electrical connector of claim 1, wherein said biasing member includes a plurality of retention beams mounted to and extending downward from said retention clip, said retention beams projecting toward said socket, said retention beams pressing against a module when the retention clip is interlocked to the socket.

6. The electrical connector of claim 1, wherein said biasing member includes fingers integrally formed with a top surface of said retention clip, said fingers bending downward into said chamber.

7. The electrical connector of claim 1, wherein said biasing member includes fingers integrally formed with said clip end walls, said fingers bending inward to project toward and forcibly engage a module.

8. The electrical connector of claim 1, said biasing member maintaining first engaging surfaces on said contacts in electrical communication with a module.

9. The electrical connector of claim 1, further including a locking protrusion mounted at least one socket end wall of said socket, and an opening in at least one clip end wall of said retention clip, said locking protrusion snapping securely into said opening to secure said retention clip to said socket.

10. The electrical connector of claim 1, further including opposed latches mounted on said socket, each of said opposed latches snapably engaging one of said clip end walls of said retention clip, said opposed latches including protrusions and outer edges located below and recessed inward from said protrusions, said outer edges and protrusions defining a recessed bench receiving one of said clip end walls such that outer surfaces of each of said clip end walls are flush with an outer edge of one of said protrusions.

11. The electrical connector of claim 1, said clip end walls integrally formed with support ribs, said support ribs biasing said clip end walls inward toward one another to snapably engage opposite ends of said socket, said clip end walls being bendable outward to release said socket.

12. The electrical connector of claim 1, said socket including standoffs mounted on a bottom surface of said socket, said standoffs having a predetermined length maintaining a minimum distance between said socket and a circuit board, to prevent said contacts from being crushed during mounting of said socket on the circuit board.

13. The electrical connector of claim 1, wherein said socket further includes a plurality of board locking members including a plurality of board locks projecting downward from said socket, said board locks including retention barbs on a periphery thereof forming an interference fit with corresponding openings in the circuit board.

14. The electrical connector of claim 1, said socket having board lock housings extending outward from opposite sides of said socket, said board lock housings frictionally retaining board locking members of said socket.

15. The electrical connector of claim 1, including a slot extending between said socket and said retention clip to receive a tool to release said retention clip from said socket.

16. The electrical connector of claim 1, said socket end walls and socket side walls laterally and longitudinally locate a module in a desired position relative to said contacts.

17. The electrical connector of claim 1, said socket including keys shaped to mate with corresponding cutouts in a module, said keys ensuring proper orientation of the module.

18. The electrical connector of claim 1, wherein said base of said socket includes latches mounted on said socket end walls, said latches being located on opposite ends of a module, said latches defining an outer envelope of said connector, said latches including recessed benches receiving clip end walls of said retention clip such that said clip end walls are recessed inward within said envelope defined by said latches.

19. An electrical connector for electronically engaging an electronic module with a printed circuit board, comprising:

a socket having a base adapted to receive the module, said socket including a plurality of board locking members surface mounting said socket to the circuit board, said socket including a plurality of contact cavities;

contacts securely fixed in the contact cavities, each contact having a first engaging surface for electronically engaging the module and having a second engaging surface for electronically engaging the circuit board;

a retention clip removably secured to said socket and cooperating with said socket to sandwich the module therebetween, said retention clip having at least one end wall and at least one side wall, and a configuration of at least one support rib interconnecting said at least one of end wall and said at least one side wall; and a locking assembly interlocking said retention clip and socket, said retention clip including at least one biasing member abutting against and biasing the electronic module against the socket when the retention clip is interlocked to the socket, said locking assembly including a locking protrusion mounted on at least one end of said socket, and an opening in at least one end wall of said retention clip, said locking protrusion snapping securely into said opening to secure said retention clip to said socket.

20. The electrical connector of claim 19, said locking assembly including a slot extending between said socket and said retention clip to receive a tool to release said retention clip from said socket.

21. The electrical connector of claim 19, said socket including end and side walls to laterally and longitudinally locate the module in a desired position relative to said contacts.

22. The electrical connector of claim 19, said socket including keys shaped to mate with corresponding cutouts in the module, said keys ensuring proper orientation of the module.

23. The electrical connector of claim 19, wherein said socket includes a base platform with latches mounted on said base platform, said latches being located on opposite ends of the module, said latches defining an outer envelope of said connector, said latches including recessed benches receiving end walls of said retention clip such that said end walls are recessed inward within said envelope defined by said latches.

24. An electrical connector for electronically engaging an electronic module with a printed circuit board, comprising:

a socket having a base adapted to receive the module, said socket including a plurality of board locking members surface mounting said socket to the circuit board, said socket including a plurality of contact cavities;

contacts securely fixed in the contact cavities, each contact having a first engaging surface for electronically engaging the module and having a second engaging surface for electronically engaging the circuit board;

a retention clip removably secured to said socket and cooperating with said socket to sandwich the module therebetween, said retention clip having end walls and side walls, and a configuration of at least one support rib interconnecting one of said end walls to one of said side walls, said end walls integrally formed with said at least one support rib, said at least one support rib biasing said end walls inward toward one another to snapably engage opposite ends of said socket, said end walls being bendable outward to release said socket; and a locking assembly interlocking said retention clip and socket, said retention clip including at least one biasing member abutting against and biasing the electronic module against the socket when the retention clip is interlocked to the socket.

25. The electrical connector of claim 24, said locking assembly including a slot extending between said socket and said retention clip to receive a tool to release said retention clip from said socket.

26. The electrical connector of claim 24, said socket including end and side walls to laterally and longitudinally locate the module in a desired position relative to said contacts.

27. The electrical connector of claim 24, said socket including keys shaped to mate with corresponding cutouts in the module, said keys ensuring proper orientation of the module.

28. The electrical connector of claim 24, wherein said socket includes a base platform with latches mounted on said base platform, said latches being located on opposite ends of the module, said latches defining an outer envelope of said connector, said latches including recessed benches receiving end walls of said retention clip such that said end walls are recessed inward within said envelope defined by said latches.

* * * * *